US005663738A

United States Patent [19]

Mueller

[11] Patent Number: 5,663,738

[45] Date of Patent: Sep. 2, 1997

[54] ANTENNA DEVICE

[75] Inventor: Philipp Mueller, Greifensee, Switzerland

[73] Assignee: Actron Entwicklungs AG, Rotkreuz, Switzerland

[21] Appl. No.: 643,097

[22] Filed: May 2, 1996

Related U.S. Application Data

[63] Continuation of Ser. No. 274,191, Jul. 12, 1994, abandoned.

[30] Foreign Application Priority Data

Jul. 13, 1993 [CH] Switzerland ..... 2094/93

[51] Int. Cl.[6] ..... H01Q 11/12

[52] U.S. Cl. ..... 343/742; 343/867; 343/870

[58] Field of Search ..... 343/741, 742, 343/743, 744, 841, 842, 866, 867, 870

[56] References Cited

U.S. PATENT DOCUMENTS

| | | | |
|---|---|---|---|
| 2,597,518 | 10/1952 | Parks . | |
| 4,016,553 | 4/1977 | Novikoff et al. | 343/867 |
| 4,135,183 | 1/1979 | Heltemes | 340/572 X |
| 4,243,980 | 1/1981 | Lichtblau | 340/572 |
| 4,251,808 | 2/1981 | Lichtblau | 340/572 |
| 4,260,990 | 4/1981 | Lichtblau | 343/742 |
| 4,633,250 | 12/1986 | Anderson, III et al. | 343/742 X |
| 4,679,046 | 7/1987 | Curtis et al. | 343/867 X |
| 4,720,701 | 1/1988 | Lichtblau | 340/572 |
| 4,751,516 | 6/1988 | Lichtblau | 340/572 |
| 4,859,991 | 8/1989 | Watkins et al. | 343/867 X |
| 4,866,455 | 9/1989 | Lichtblau | 343/867 X |
| 4,872,018 | 10/1989 | Feltz et al. | 343/842 X |
| 4,999,641 | 3/1991 | Cordery et al. | 343/842 X |
| 5,061,941 | 10/1991 | Lizzi et al. | 343/742 |
| 5,345,222 | 9/1994 | Davies et al. | 343/841 X |

FOREIGN PATENT DOCUMENTS

| | | |
|---|---|---|
| A 0440 370 | 8/1991 | European Pat. Off. . |
| 4027 710 A1 | 3/1991 | Germany . |

*Primary Examiner*—Donald T. Hajec
*Assistant Examiner*—Tan Ho
*Attorney, Agent, or Firm*—Finnegan, Henderson, Farabow, Garrett & Dunner, L.L.P.

[57] ABSTRACT

The antenna device has an antenna wire loop which, accompanied by the formation of two electrically outer (1,3) and one electrically central partial loop (2), is twice twisted by in each case 180°. One of the two electrically outer partial loops (3) is geometrically positioned between the electrically central partial loop (2) and the other electrically outer partial loop (1). An impedance element (11) is connected between two connecting points (9,10) located at the entrance and exit of the geometrically central partial loop. The antenna device according to the invention has a very balanced characteristic and in the case of an appropriate choice of its parameters, behaves at the resonant frequency of the tags to be detected in the same way as an antenna with approximately 2 to 2½ partial loops.

13 Claims, 6 Drawing Sheets

ANTENNA DEVICE

This application is a continuation of application Ser. No. 08/274,191, filed on Jul. 12, 1994, now abandoned.

FIELD OF THE INVENTION

The present invention relates to an antenna device for detection of resonant tags in electronic product anti-theft systems with an antenna wire loop running in a plane between two terminals and which accompanied by the formation of two electrically outer and one electrically central partial loop is twisted twice by in each case 180° and in which is connected an impedance element. The invention also relates to the use of such an antenna device for the detection of resonant tags with a fixed, predetermined resonant frequency.

BACKGROUND OF THE INVENTION

Numerous different constructions and geometries of antenna devices for electronic product anti-theft systems are known and in use. Reference can e.g. be made to: U.S. Pat. No. 4,251,808, U.S. Pat. No. 4,135,183, U.S. Pat. No. 4,243,980, U.S. Pat. No. 4,751,516, U.S. Pat. No. 872,018, U.S. Pat. No. 4,260,990, U.S. Pat. No. 4,016,553, U.S. Pat. No. 4,720,701, EP-A2-414,628, FR-763,681. Reference can also be made to U.S. Pat. No. 2,597,518, which describes a receiving antenna with several partial loops twisted with respect to one another by 180°.

FIG. 1 shows an antenna device, such as is frequently used at present. It has in series three partial loops 1,2 and 3 in each case reciprocally twisted by 180°. The twisting of the partial loops against one another is for far field cancellation purposes. The ohmic resistors 7,8 provided at the intersection points 5 and 6 serve to somewhat "blur" the antenna characteristics and therefore avoid detection dead zones. FIG. 2 shows a field intensity distribution produced by this antenna device at a distance of 30 cm above the xy plane of the three partial loops. In accordance with the three partial loops there are three maxima, the field intensity decreasing from the first to the third partial loop. This undesired intensity decrease is caused by the current intensity decreasing between the individual loops. The overall inductance of the antenna device also determines or limits the antenna current, in addition to the voltage applied to the antenna terminals and this must be as large as possible. In modern systems there is a voltage of approximately 50 V at the antenna terminals 12. An increase in the antenna current by increasing said voltage is only possible with considerable effort and expenditure.

SUMMARY OF THE INVENTION

The problem of the invention is to so further develop an antenna device of the aforementioned type that it has more balanced characteristics with an at least identically high, local emission capacity. According to the invention, this problem is solved by an antenna device for the detection of resonant tags in electronic product anti-theft systems, comprising an antenna wire loop running in a plane between two terminals (12) and including two electrically outer partial loops (1,3) and one electrically central partial loop (2) twisted twice by, in each case, 180°; and an impedance element (11), wherein one (3) of the two electrically outer partial loops (1,3) is positioned as a geometrically central partial loop between the electrically central partial loop (2) and the other electrically outer partial loop (1), and the impedance element (11) is connected between two connections points (9,10) at current entrance and exit portions of the geometrically central partial loop (3) and includes a parallel connection of a capacitor (c) and an ohmic resistor (R).

For detecting resonant tags with a fixed, predetermined resonant frequency the antenna device according to the invention comprises an ohmic resistor, a capacitor connected to the ohmic resistor, and an inductance coupled to the capacitor, said ohmic resistor, capacitor, and inductance included in a geometrically central partial loop of the antenna, the capacitor and inductance having an alternating current impedance for a given resonant frequency of the resonant tag substantially equal to the ohmic resistance of said ohmic resistor.

Preferred developments of the invention are characterized in the dependent claims.

EMBODIMENTS

Figure 1:
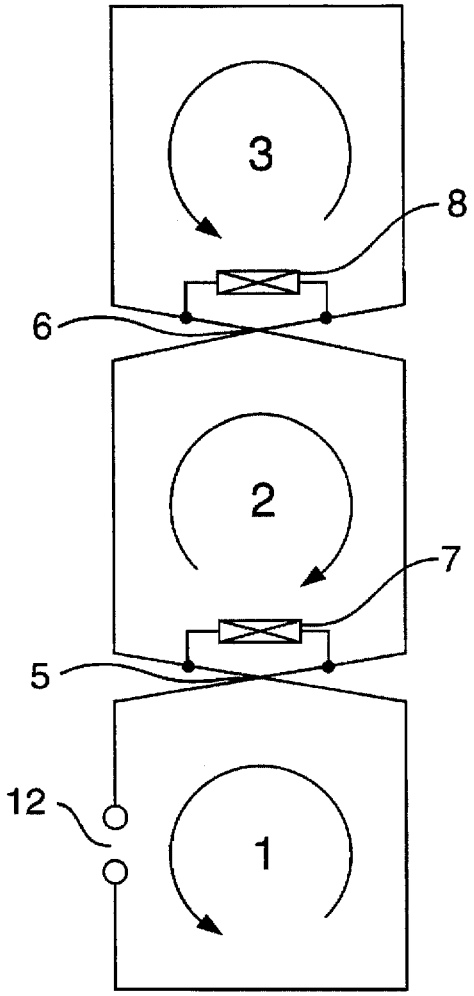
FIG. 1 PRIOR ART
FIG. 1 shows a prior art antenna device.
Figure 4:
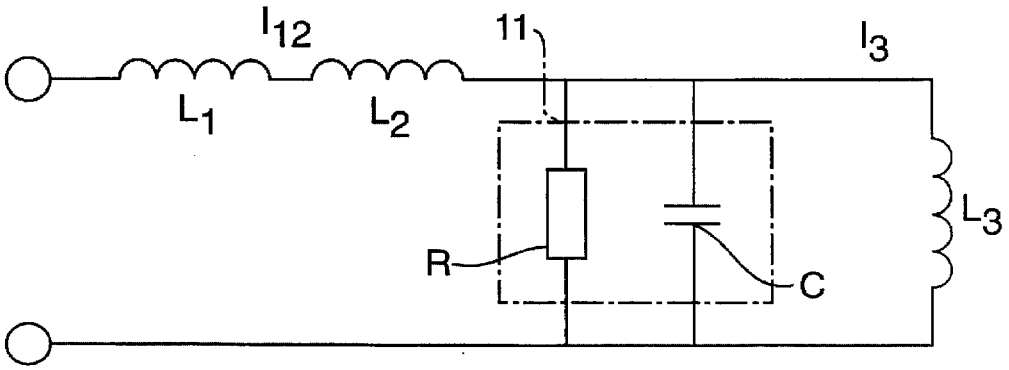
FIG. 4 is an equivalent circuit diagram of the antenna device of FIG. 3*d*.
Figure 3A:
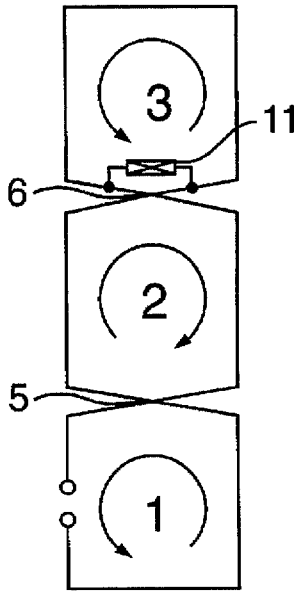
FIG. 3a PRIOR ART
FIG. 3*a* illustrates a conventional antenna device.

FIG. 3*a* shows a conventional antenna device with three series-arranged partial loops 1,2,3, which are in each case twisted against one another by 180°. At the intersection 6 between the second and third partial loops 2,3, respectively between two connection points 9,10 at the inlet and outlet of the third partial loop 3, is provided an impedance element as seen in FIG. 3*d* 11. As shown in FIG. 4, the impedance element 11 is formed by a parallel connection of a capacitor C and an ohmic resistor R.

Figure 3B:
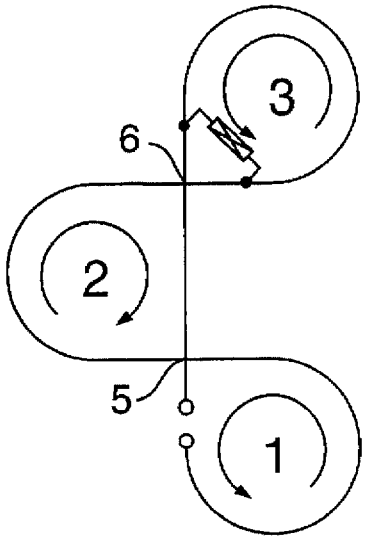
FIG. 3*b* shows the displacement of three partial loops of the antenna of FIG. 3*a*.
Figure 3C:
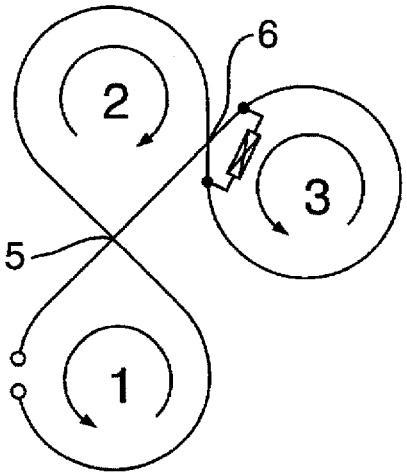
FIG. 3*c* shows the further displacement of three partial loops of the antenna shown in FIG. 3*a*.
Figure 3D:
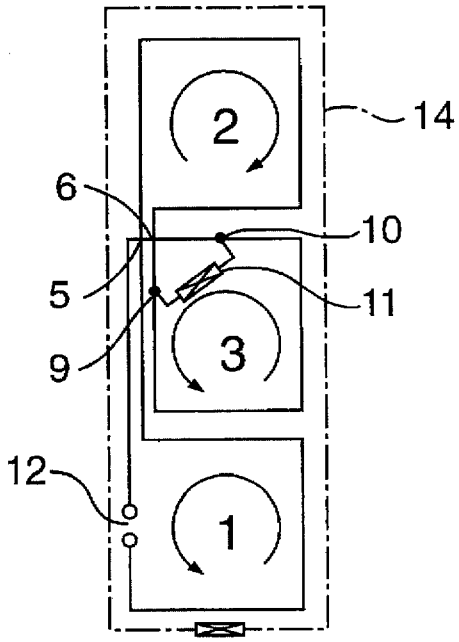
FIG. 3*d* shows an antenna according to the present invention.

Through the displacement of the three partial loops in the manner shown in FIGS. 3*b* and 3*c*, it is possible to pass from the arrangement shown under 3*a* to that according to FIG. 3*d*, which is in accordance with the present invention. The electrically outer partial loop 3 is geometrically positioned between the partial loops 1 and 2.

In the equivalent circuit diagram of the antenna device according to FIG. 3*d* shown in FIG. 4 it is possible to see that the inductance $L_3$ of the geometrically central partial loop 3, together with the capacitor C of the impedance element 11, forms a resonant circuit. This resonant circuit acts as a barrier element at its resonant frequency. The current $I_3$ flowing in it or respectively in the geometrically central partial loop is, in the case of resonance phase-displaced by 90° with respect to the current $I_{12}$ in the two other partial loops 1 and 2. The current $I_{12}$ flows across the resistor R and advantageously only "experiences" the inductances $L_1$ and $L_2$ of the first and second partial loops. Thus, for frequencies in the vicinity of said resonant frequency and despite the three partial loops, the impedance of the antenna device according to the invention behaves like one having only 2 or 2½ partial loops.

For the detection of resonant tags with a fixed, predetermined resonant frequency, the antenna device according to the invention is preferably dimensioned in such a way that said resonance case occurs specifically at the predetermined resonant frequency of the resonant tags. This is e.g. the case if the alternating current impedance formed by the capacitor C and by the inductance $L_3$ of the third partial loop at the predetermined resonant frequency of the tags have the same amount as the ohmic resistor R. Then $L=R^2C$ applies. For a given resonant frequency of 8.2 MHz and $L_3$=1.63 μH, for R there is e.g. a value of 84 Ω and for C a value of 235 pF.

Figure 2:
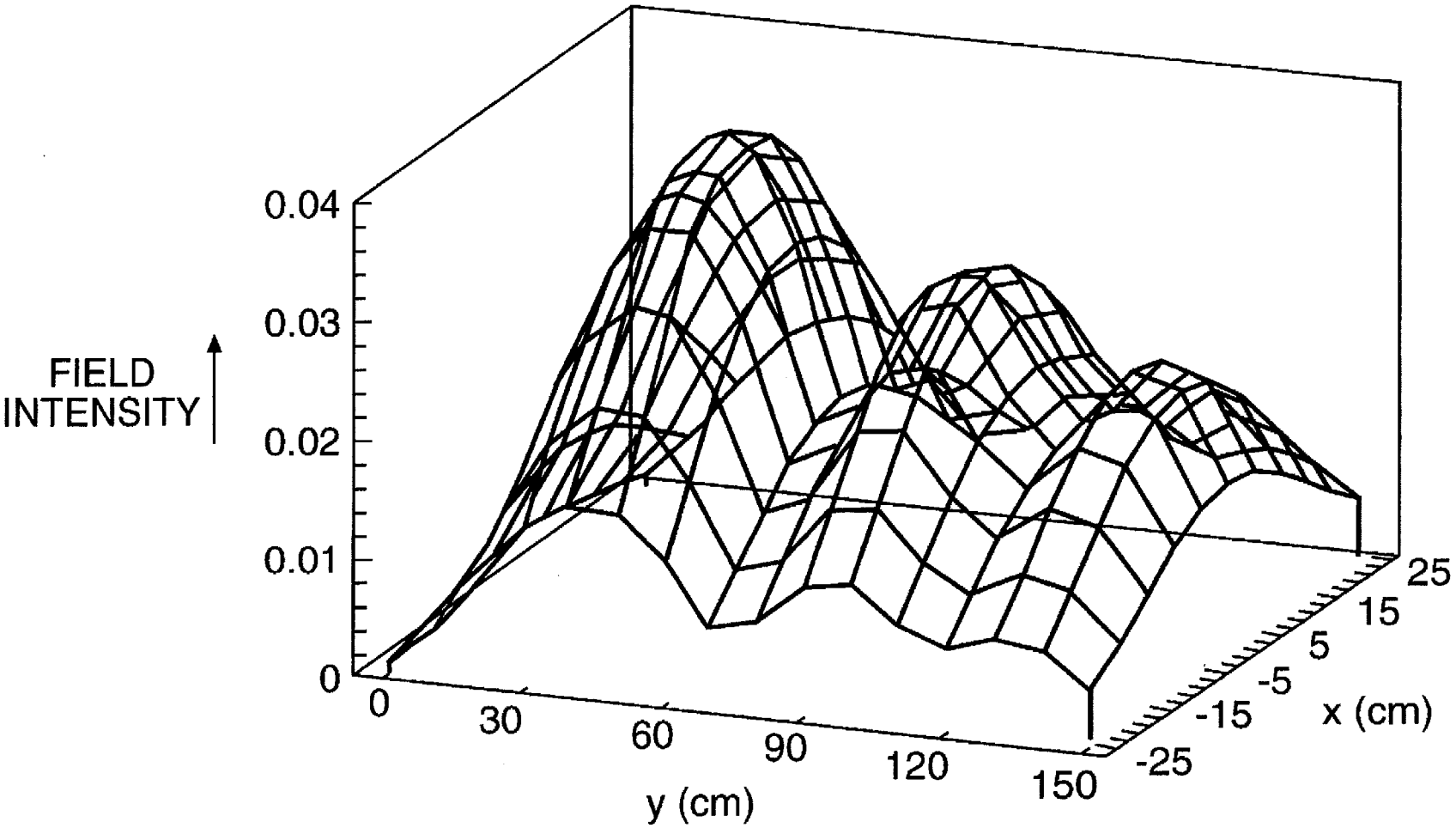
FIG. 2 shows the characteristics of the antenna device of FIG. 1.
Figure 5:
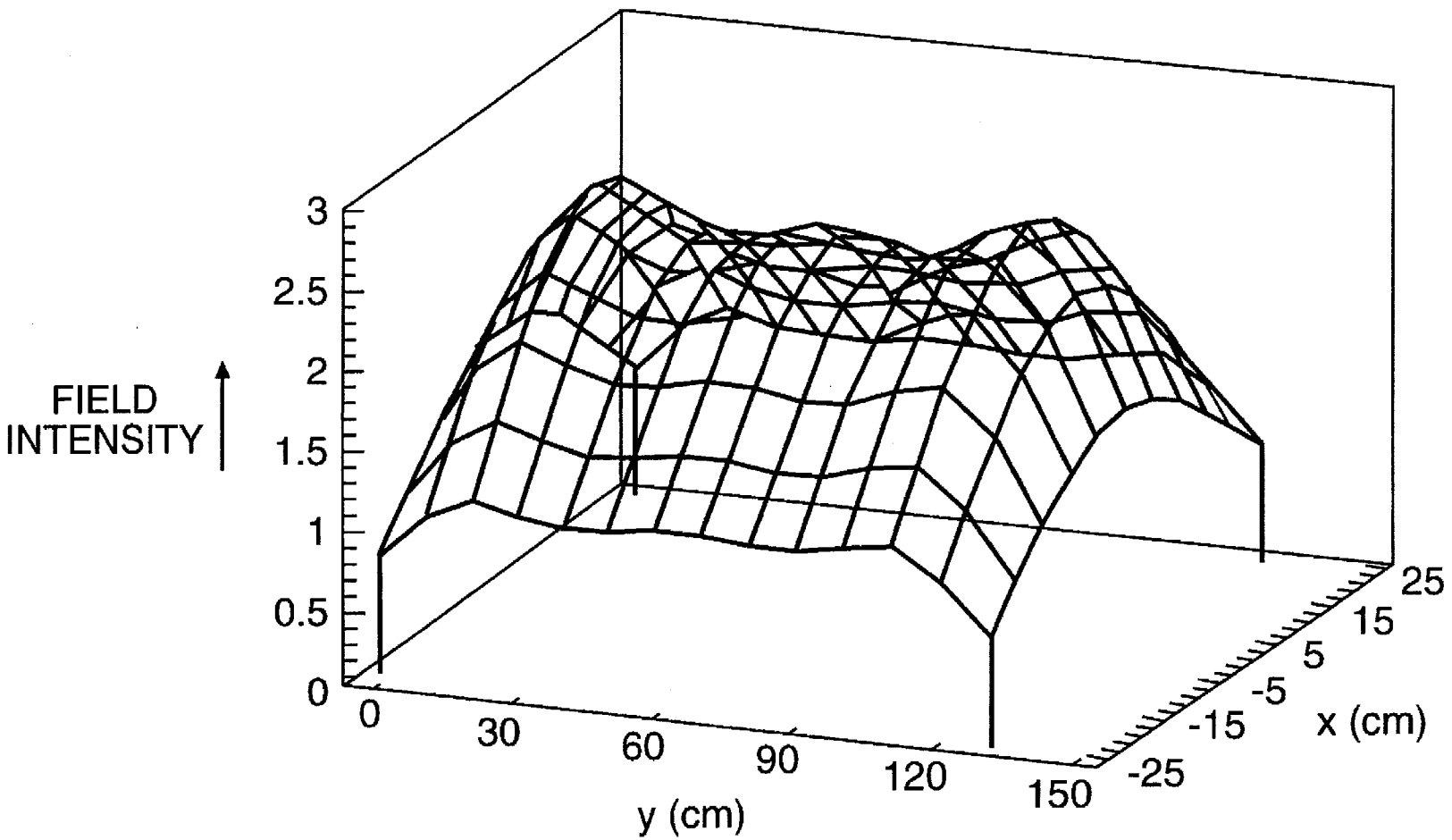
FIG. 5 shows the characteristics of the antenna device of FIG. 3*d*.

FIG. 5 shows in a diagram corresponding to FIG. 2 the characteristics of the antenna device according to FIG. 3*d* in the case of resonance. It is much more uniform than that of FIG. 2. In particular, the undesired intensity drop from left to right has disappeared. The amount of the intensity is also higher overall, because the inductance $L_3$ of the third partial loop does not have a limiting effect on the effective antenna current $I_{12}$.

Figure 6:
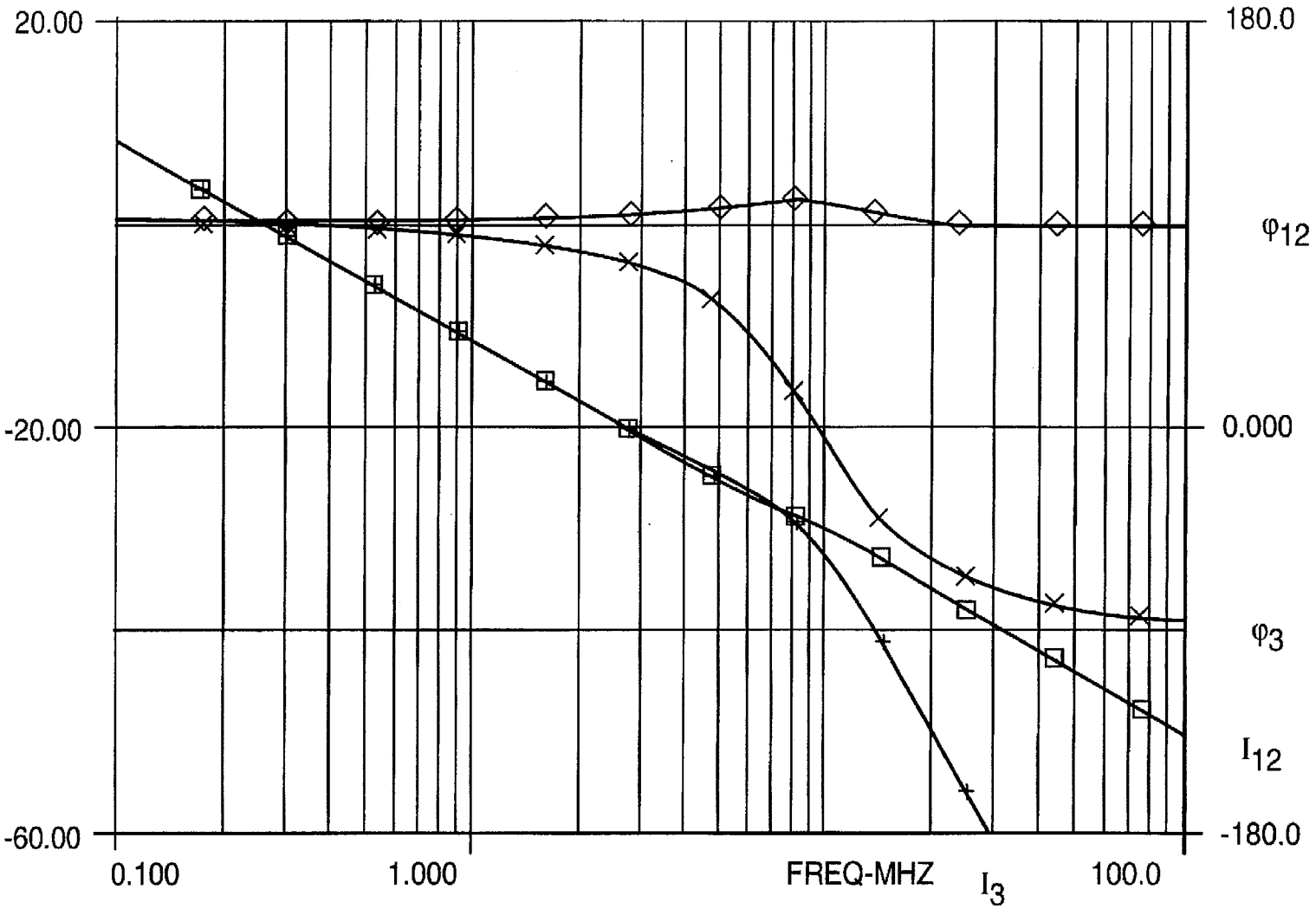
FIG. 6 is a logarithmic diagram of the frequency responses of currents occurring in an antenna device according to FIG. 3*d*, as well as their phase angles.

FIG. 6 shows for the same antenna device the frequency responses of the currents $I_{12}$ and $I_3$, as well as their phase angles $\phi_{12}$ and $\phi_3$. At approximately 8.2 MHz the current $I_3$ is phase-displaced by 90° compared with the current $I_{12}$.

Figure 7A:
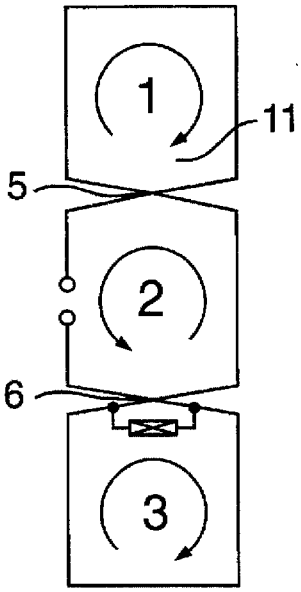
FIG. 7a PRIOR ART
FIG. 7*a* shows a conventional antenna device with three series-arranged partial loops.
Figure 7B:
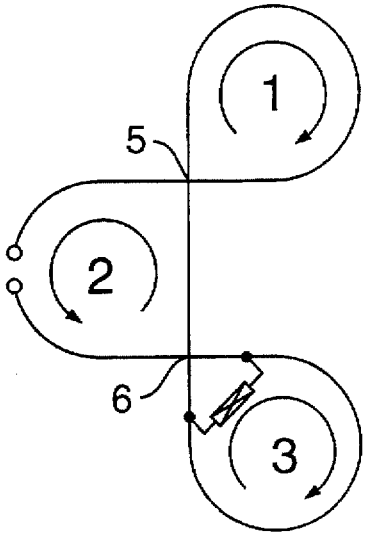
FIG. 7*b* shows the antenna of FIG. 7*a* with three loops displaced.
Figure 7C:
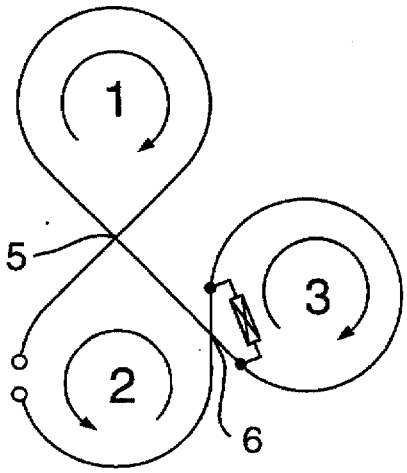
FIG. 7*c* shows the antenna of FIG. 7*a* with three partial loops further displaced.

In a representation corresponding to FIGS. 3*a*–3*d*, FIGS. 7*a*–7*d* show a further embodiment of an antenna device according to the invention (FIG. 7*d*), as well as its derivation from a conventional system (FIG. 7*a*). FIGS. 7*a*–7*d* differ from FIGS. 3*a*–3*d* by the arrangement of the antenna terminals 12. In FIGS. 3*a*–3*d* the terminals are located in the first partial loop 1 and in FIG. 7 in the second partial loop 2. With respect to the geometrically central partial loop 3, in the two embodiments there is an oppositely directed current flow direction. Otherwise the two embodiments are equivalent to one another. In the vicinity of the central partial loop 3, the terminals 12 could also be located in one of the lines passing through them.

The surface area of the three partial loops is preferably identical. However, it would also be possible to have different surface areas. The described matching of the parameters of the antenna device to the resonant frequency of the resonant tags to be detected need not necessarily be precise. In certain circumstances it would be possible to accept a phase error of up to 30° (compared with the. 90° phase shift in the resonant case).

Figure 7D:
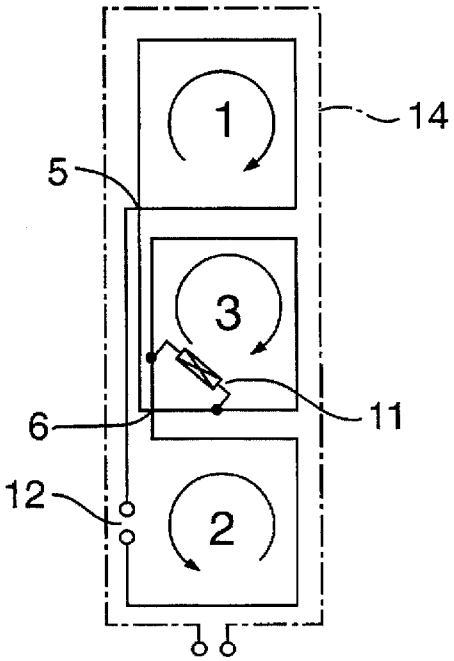
FIG. 7*d* shows a further embodiment of an antenna device according to the present invention.

In both FIGS. 3*d* and 7*d* in broken line form is shown in single-loop form a short-circuit loop 14 placed around the three partial loops 1,2,3 and which is used for improving the far field cancellation (3 to 30 m). It is of an optimum nature if the flows in the covered area compensate one another. If this is the case, then the current in the outer loop is zero. If not, the current formed in the loop acts against the inner loop and consequently forces cancellation. A resistor can be used in place of the short-circuit in the outer loop to avoid undesired resonances.

Advantageously, all the loops of the antenna device according to the invention are embedded in a plastic casing, so as to bring about mechanical stabilization. A plastic casing has the advantage that it has no disadvantageous effect on the advantageous characteristics of the antenna device according to the invention. In the case of a spatial combination with a transmitting or receiving electronics, for the same reason the latter should also be placed in a plastic casing.

Finally, the antenna device according to the invention can be provided on one side with a screening plate to provide a one-sided screening effect. The screening plate would be positioned a few centimeters (e.g. 4 cm) from the plane of the antenna wire loops.

I claim:

1. An antenna device, for detection of product anti-theft resonant tags, having first, second, and third, in-line loop positions, the antenna device comprising:

first and second terminals located in one of the first and third in-line loop positions, an antenna wire arranged as a first outer loop disposed in the first loop position, a second outer loop disposed in the third loop position, and a central loop disposed in the second loop position, the first outer loop, central loop, and second outer loop lying in a common plane and each including current entry and current exit loop portions, the current entry loop portion of one of the first outer loop and second outer loop connected to the first terminal, the antenna wire further including a first wire segment extended to connect the current exit loop portion of one of another of the first and second outer loops and the central loop to the second terminal and additional wire segments interconnecting remaining current entry and current exit loop portions of the first and second outer loops and the central loop, such as to provide current flow through the first and second outer loops in relatively opposite directions; and an impedance connected between the current entry and current exit loop portions of the central loop, the impedance including a parallel connection of a capacitor and a resistor.

2. Antenna device according to claim 1, characterized in that the first and second outer loops and the central loop have the same surface area.

3. Antenna device according to claim 1, further including a short-circuit loop placed externally and in the same plane around the first and second outer loops and the central loop.

4. Antenna device according to claim 2, further including a short-circuited loop placed externally and in the same plane around the first and second outer loops and the central loop.

5. An antenna device, for detection of product anti-theft resonant tags, having first, second, and third, in-line loop positions, the antenna device comprising:

first and second terminals located in the first loop position, an antenna wire arranged as a first outer loop disposed in the first loop position, a second outer loop disposed in the third loop position, and a central loop disposed in the second loop position, the first outer loop, central loop, and second loop lying in a common plane and each including current entry and current exit loop portions, the current entry loop portion of the first outer loop connected to the first terminal, the antenna wire further including a first wire segment extended to connect the current exit loop portion of the central loop to the second terminal and additional wire segments interconnecting remaining current entry and current exit loop portions of the first and second outer loops and the central loop, such as to provide current flow through the first and second outer loops in relative opposite directions; and an impedance connected between the current entry and current exit loop portions of the central loop, the impedance including a parallel connection of a capacitor and a resistor.

6. Antenna device according to claim 5, characterized in that the first and second outer loops and the central loop have the same surface area.

7. Antenna device according to claim 5, further including a short-circuit loop placed externally and in the same plane around the first and second outer loops and the central loop.

8. Antenna device, for detection of product anti-theft resonant tags, having first, second, and third, in-line loop positions, the antenna device comprising:

first and second terminals located in the third in-line loop position, an antenna wire arranged as a first outer loop disposed in the first loop position, a second outer loop disposed in the third loop position and a central loop disposed in the second loop position, the first outer loop, central loop, and second outer loop lying in a common plane and each including current entry and current exit loop portions, the current entry loop portion of the second outer loop connected to the first terminal, the antenna wire further including a first wire segment extended to connect the current exit loop portion of the first outer loop to the second terminal and additional wire segments interconnecting remaining current entry and current exit loop portions of the first and second outer loops and the central loop, such as to provide current flow through the first and second outer loops in relative opposite directions; and an impedance connected between the current entry and current exit loop portions of the central loop, the impedance including a parallel connection of a capacitor and a resistor.

9. Antenna device according to one of the claims 1–8, characterized in that $L=R^2C$, in which L is the inductance of the central loop, R the ohmic value of the resistor and C the capacitance of the capacitor.

10. Antenna device according to claim 9, characterized in that the first and second outer loops and the central loop have the same surface area.

11. Antenna device according to claim 9, further including a short-circuit loop placed externally and in the same plane around the first and second outer loops and the central loop.

12. Antenna device according to claim 8, characterized in that the first and second outer loops and the central loop have the same surface area.

13. Antenna device according to claim 8, further including a short-circuit loop placed externally and in the same plane around the first and second outer loops and the central loop.

* * * * *